US007708217B2

(12) United States Patent
Huang

(10) Patent No.: US 7,708,217 B2
(45) Date of Patent: May 4, 2010

(54) SHREDDER WITH WASTE LEVELER AND COMPACTOR

(75) Inventor: Simon Huang, Taipei (TW)

(73) Assignee: Michilin Prosperity Co., Ltd. (TW)

( * ) Notice: Subject to any disclaimer, the term of this patent is extended or adjusted under 35 U.S.C. 154(b) by 0 days.

(21) Appl. No.: 11/974,565

(22) Filed: Oct. 15, 2007

(65) Prior Publication Data

US 2009/0095831 A1 Apr. 16, 2009

(51) Int. Cl.
*B02C 23/00* (2006.01)

(52) U.S. Cl. ..... 241/100; 241/101.2

(58) Field of Classification Search ..... 241/100, 241/101.2, 236, 101.5
See application file for complete search history.

(56) References Cited

U.S. PATENT DOCUMENTS

| | | | | |
|---|---|---|---|---|
| 791,948 | A | 6/1905 | Savell | |
| 0,942,443 | A | 12/1909 | Gallaread | |
| 1,090,914 | A | 3/1914 | Guettler | |
| 1,456,265 | A | 5/1923 | Brooks | |
| 2,230,019 | A | 1/1941 | Tucke | |
| 2,700,333 | A | 1/1955 | Polsen et al. | |
| 3,137,332 | A | 6/1964 | Bertil | |
| 3,333,617 | A | 8/1967 | Gottfried et al. | |
| 3,696,737 | A | 10/1972 | Wikner | |
| 3,727,546 | A | 4/1973 | McKinney | |
| 3,771,437 | A | 11/1973 | Brucken | |
| 3,919,932 | A | 11/1975 | Basuino | |
| 4,164,178 | A | 8/1979 | Baumann et al. | |
| 4,285,273 | A | 8/1981 | Dejarnett | |
| 4,286,515 | A | 9/1981 | Baumann et al. | |
| 4,403,519 | A | 9/1983 | Welker | |
| 5,041,374 | A | 8/1991 | Chu et al. | |
| 5,080,011 | A | 1/1992 | Paxton et al. | |
| 5,090,309 | A | 2/1992 | Lai | |
| 5,121,850 | A | 6/1992 | Morel | |
| 5,221,052 | A * | 6/1993 | Vega | 241/36 |
| 5,440,978 | A * | 8/1995 | O'Brien et al. | 100/99 |
| 5,588,358 | A | 12/1996 | Klepacki et al. | |
| 5,768,988 | A | 6/1998 | Meloni | |
| 5,771,794 | A | 6/1998 | Benizri et al. | |
| 5,884,556 | A * | 3/1999 | Klepacki et al. | 100/349 |
| 5,960,710 | A | 10/1999 | Holtom | |
| 6,550,701 | B1 | 4/2003 | Chang | |
| 6,851,354 | B2 * | 2/2005 | Morisse | 100/25 |
| 6,859,005 | B2 | 2/2005 | Boliver | |
| 6,889,604 | B2 | 5/2005 | Ernst | |
| 6,959,643 | B1 | 11/2005 | Sammons et al. | |
| 7,077,059 | B1 | 7/2006 | Cobb | |
| 7,150,422 | B2 * | 12/2006 | Wang | 241/100 |
| 2004/0129810 | A1 * | 7/2004 | Kasprowicz et al. | 241/101.2 |
| 2007/0145170 | A1 * | 6/2007 | Easton et al. | 241/100 |
| 2008/0156914 | A1 | 7/2008 | Huang | |
| 2008/0230640 | A1 * | 9/2008 | Mussig et al. | 241/100 |
| 2008/0283645 | A1 | 11/2008 | Mussig et al. | |
| 2009/0038437 | A1 | 2/2009 | Huang | |
| 2009/0050643 | A1 | 2/2009 | Wang | |
| 2009/0095831 | A1 | 4/2009 | Huang | |

* cited by examiner

*Primary Examiner*—Faye Francis
(74) *Attorney, Agent, or Firm*—Venable LLP; Roy A. Kim

(57) ABSTRACT

The present invention relates generally to a shredder waste leveler and a shredder waste compactor. Specifically, this invention discloses a shredder waste leveler which levels shredder waste as it accumulates in the shredder base. In addition, this invention discloses a shredder waste compactor which compacts shredded material.

1 Claim, 4 Drawing Sheets

SHREDDER WITH WASTE LEVELER AND COMPACTOR

BACKGROUND OF THE INVENTION

1. Field of the Invention

The present invention relates generally to a shredder waste leveler and a shredder waste compactor. Specifically, this invention discloses a shredder waste leveler which levels shredder waste as it accumulates in the shredder base. In addition, this invention discloses a shredder waste compactor which compacts shredded material.

2. Background Information

With increased privacy concerns, shredders have become an integral part in both homes and businesses. Though originally used to destroy paper products, shredders are now used to shred other forms of media that hold information, such as compact discs. In addition, credit cards and other plastic products are commonly shredded.

Conventional shredders have a waste basket or base for collecting material that is shredded. Shredders also have full bin detectors which detect when a base is full of shredded material. Without a full bin detector, a shredder is prone to jam when full because shredded material will not fall freely into the base, or previously shredded material may feed upwards into the shredding mechanism.

Shredded material typically accumulates in a mound shape resulting in the full bin detector going off prior to the entire bin actually being full. Accordingly, the present invention discloses various shredder waste leveler and compactor configurations which increase the amount of material that the base can hold prior to the full bin detector going off.

One preferred embodiment of the claimed invention discloses a foot pedal with a pedal arm. As the foot pedal is depressed the pedal arm redistributes and levels the shredded material. Another preferred embodiment of the claimed invention discloses a foot pedal connected to a compacting arm. In this embodiment, as the foot pedal is depressed, the compacting arm presses down and compacts the shredded material.

From the preceding descriptions, it is apparent that the devices currently being used have significant disadvantages and/or limitations. Thus, important aspects of the technology used in the field of invention remain amenable to useful refinement.

SUMMARY OF THE INVENTION

The present invention relates to an apparatus that satisfies the need for a shredder waste leveler or compactor.

In one preferred embodiment, a user may depress a pedal which is connected to a hinge in the shredder base. As the pedal is depressed, the pedal arm inside the base moves upward to displace shredded material. As the pedal is released, the pedal arm moves back down and the shredded material falls into a level formation.

In another preferred embodiments, as the user depresses a pedal, a compacting arm comes down and compresses the shredded material.

All of the foregoing operational principles and advantages of the present invention will be more fully appreciated upon consideration of the following detailed description with reference to the drawings.

BRIEF DESCRIPTION OF THE DRAWINGS

The features and advantages of this invention are better understood with regard to the following drawings, description, and claims. The drawings consist of the following:

DETAILED DESCRIPTION OF THE INVENTION

Figure 1:
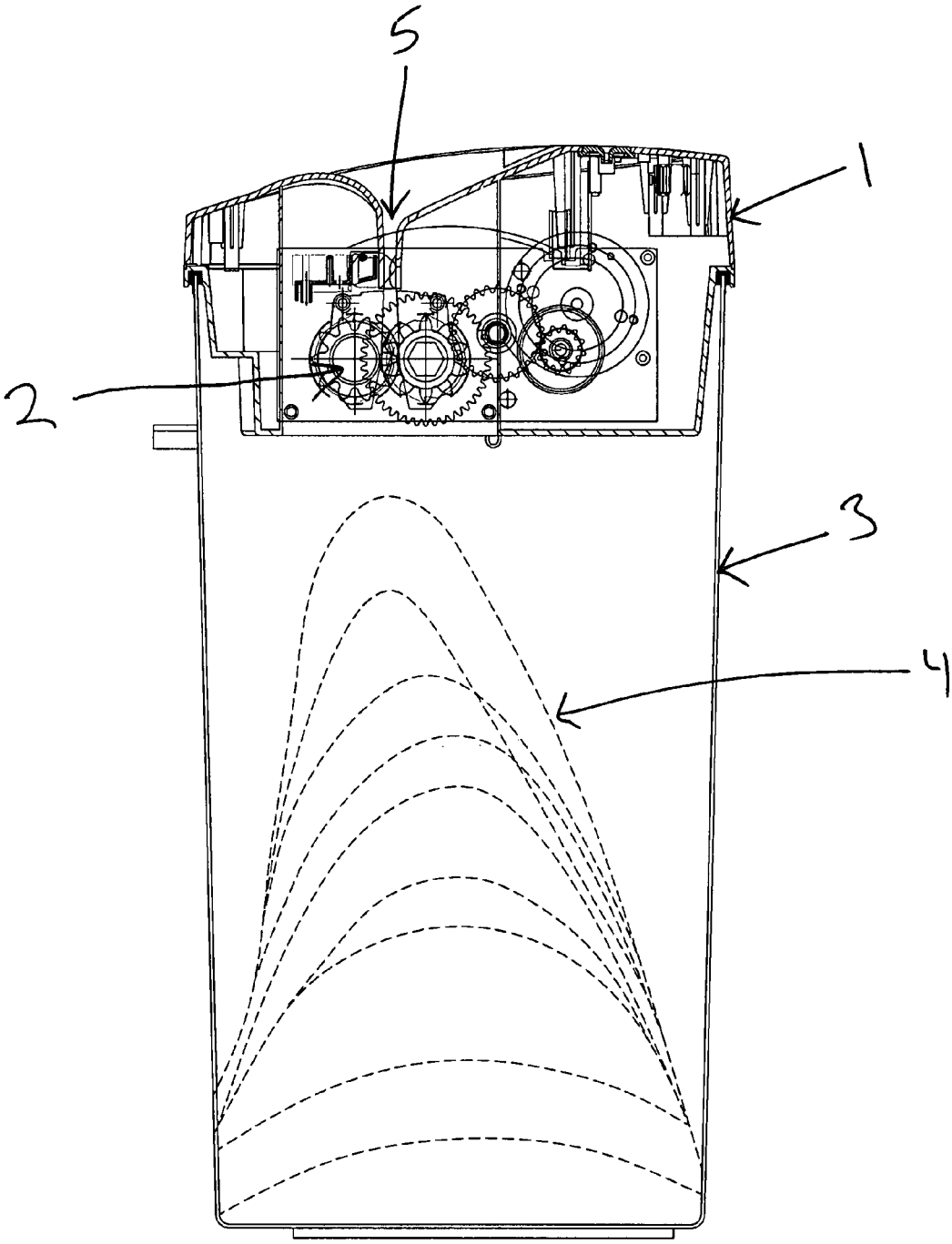
FIG. 1 is a cross-sectional view of a shredder with accumulated waste.

The essential elements of a shredder are comprised of a housing 1, a shredder mechanism 2 which is located inside the housing 1, and a base 3 which supports the housing 1 and collects the shredded material 4. The housing 1 has an opening or throat 5 that leads to the shredding mechanism 2. Material to be shredded is then fed through the throat 5 and into the shredding mechanism 2. Shredders also may have a full bin detector which activates a shut-off mechanism or notification system when the base becomes full of shredded material.

This invention discloses various shredder waste leveler and compaction mechanisms which allow for more material to be shredded prior to activating the full bin detector.

FIG. 1 discloses a conventional shredder and the pattern by which shredded material 4 accumulates. It typically accumulates in a mound type fashion resulting in much wasted space on each side of the mound of shredded material.

Figure 2:
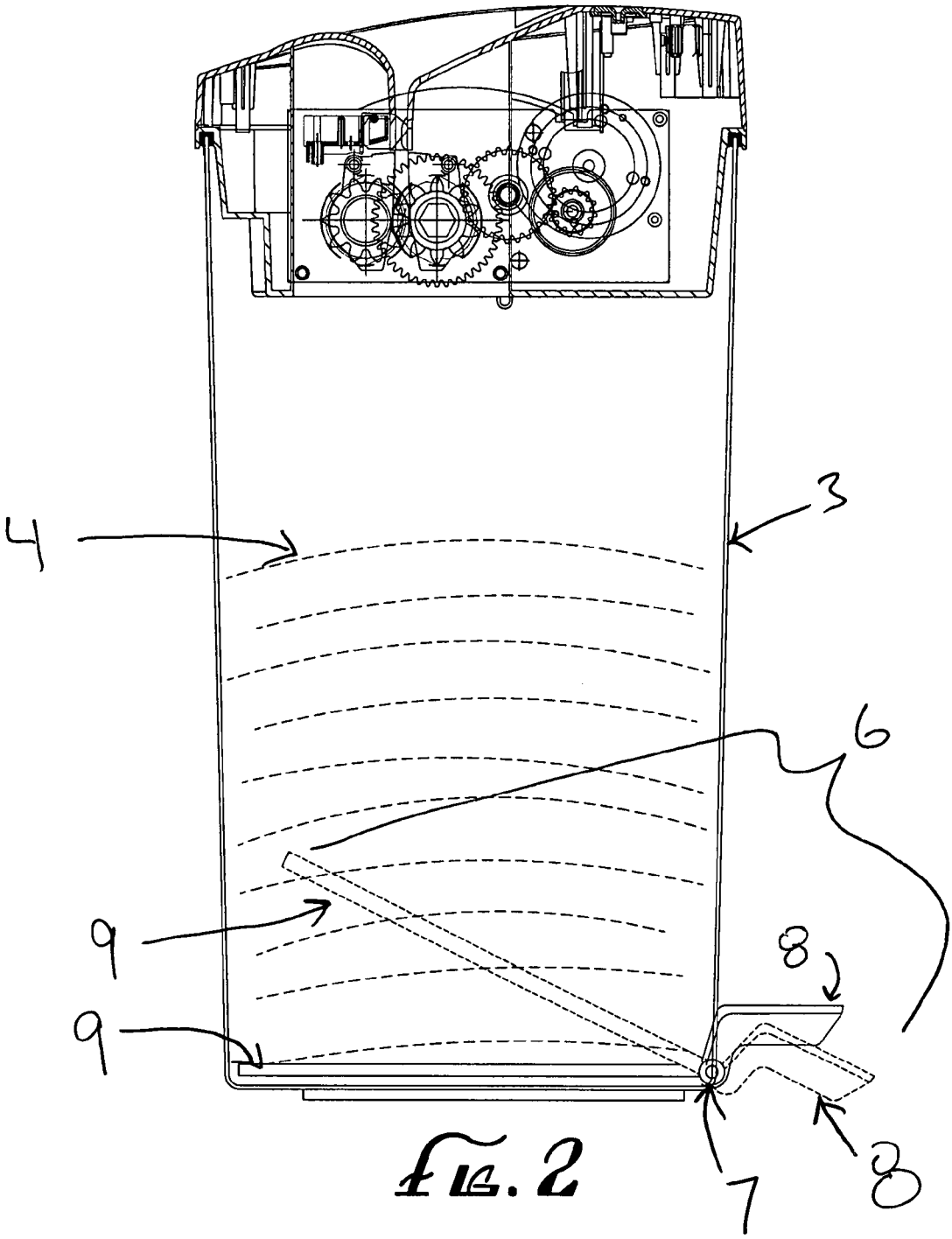
FIG. 2 is an cross-sectional view of a shredder waste leveler embodying features of this invention.

FIG. 2 discloses a preferred embodiment. A pedal lever 6 is connected via a hinge 7 to the base 3. Any hinge or other joint may be used to connect the pedal lever to the base as readily known to those skilled in the art. The foot pedal 8 is the portion of the pedal lever 6 that extends outside of the base. The portion of the pedal lever 6 that extends into the base is the pedal arm 9. The hinge 7 acts as a fulcrum such that when the foot pedal 8 is depressed, the pedal arm 9 inside the base 3 is raised. As the pedal arm 9 raises, shredded material 4 moves upward and then resettles in a level fashion.

Figure 3:
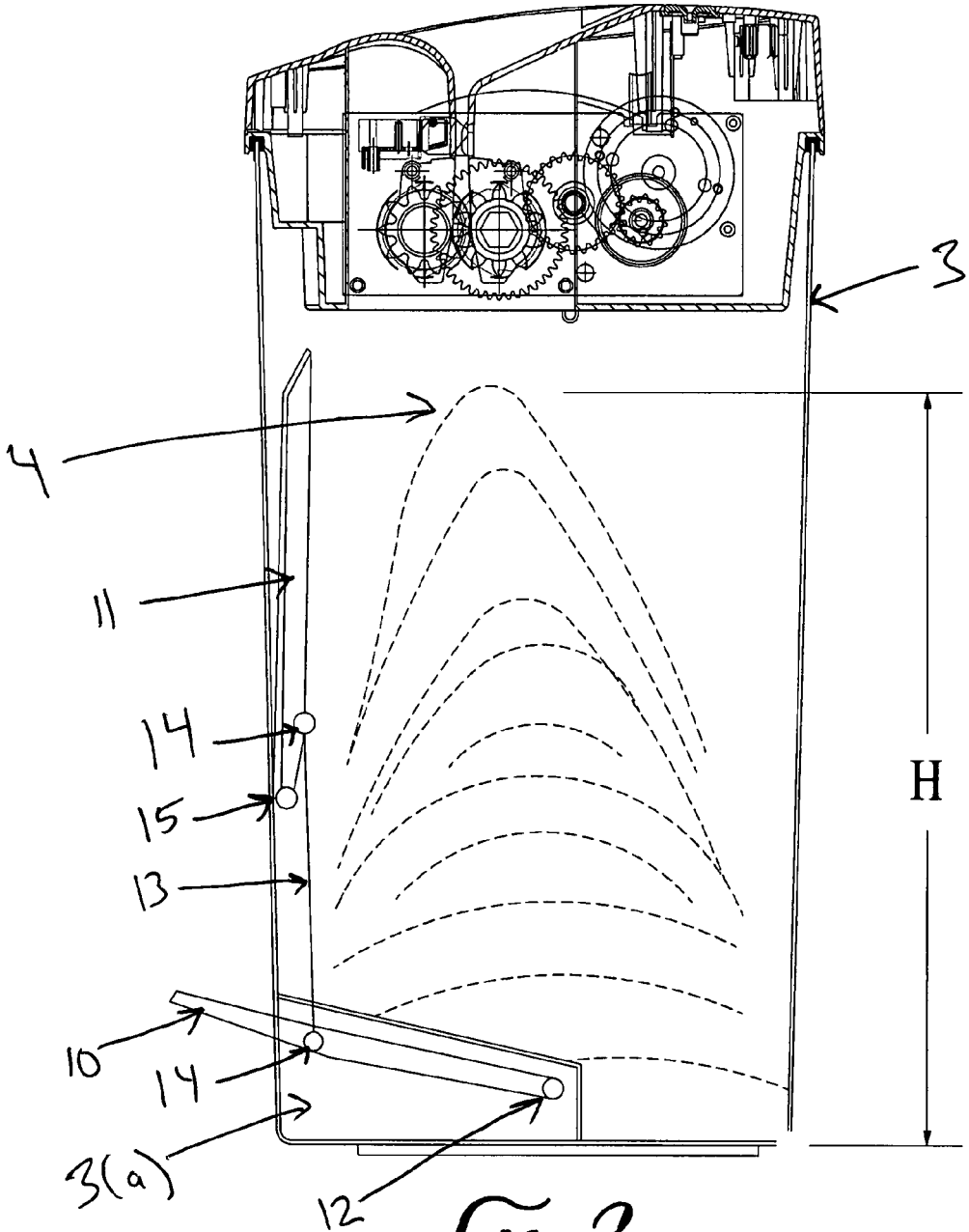
FIG. 3 is a cross-sectional view of a shredder waste compactor embodying features of this invention.
Figure 4:
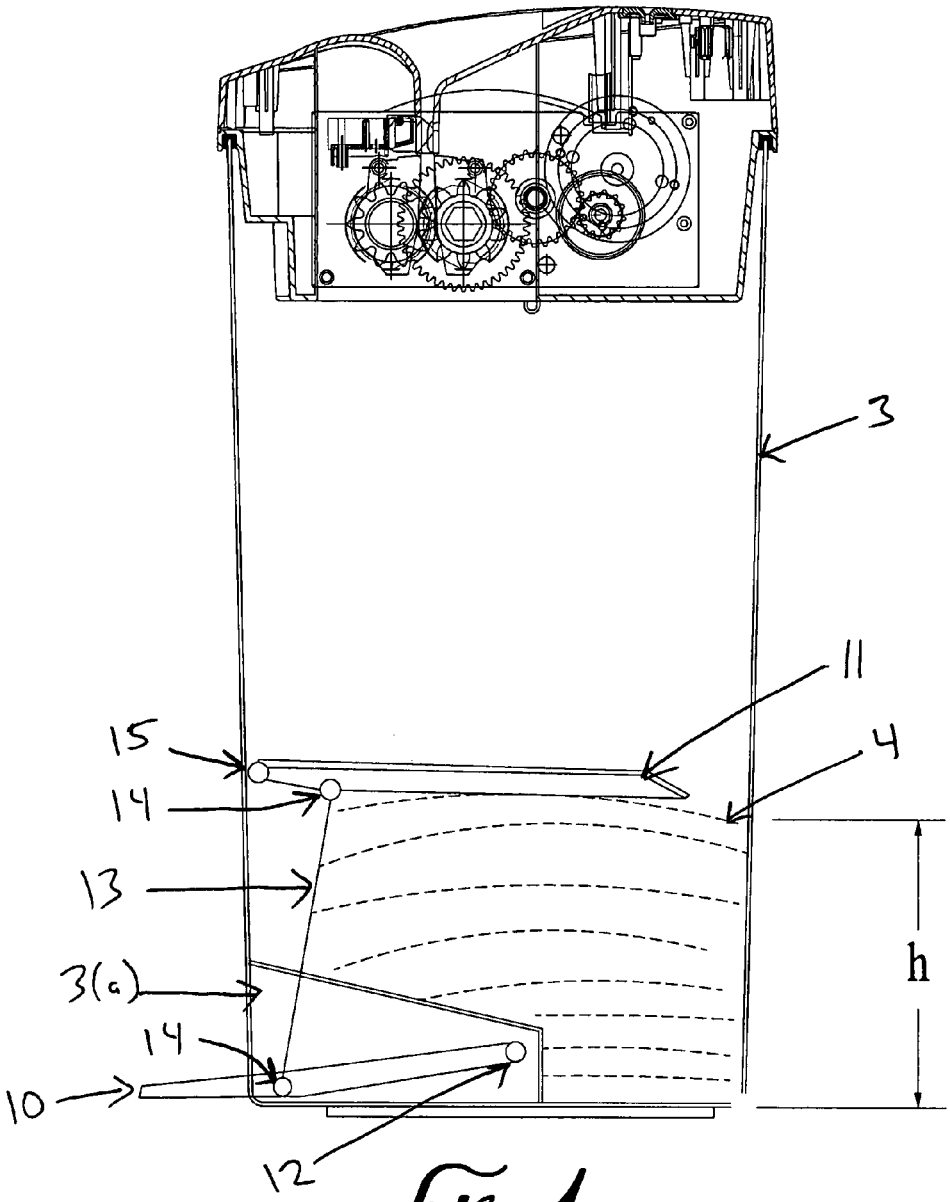
FIG. 4 is cross-sectional view of a shredder waste compactor embodying features of this invention.

FIGS. 3 and 4 disclose another preferred embodiment whereby a pedal 10 is connected to a compacting arm 11 which compresses shredded material 4 when the pedal 10 is depressed. In the preferred embodiment, the shredder base 3 has a recess 3(*a*) wherein part of the pedal 10 is located. At the far end of the recess, the pedal 10 connects to a hinge 12 on the base 3. Any hinge or other joint may be used to connect the pedal to the base as readily known to those skilled in the art. The other end of the pedal 10 protrudes from the recess 3(*a*) such that the user can readily press on it.

The pedal 10 is connected to the compacting arm 11 via a bar 13. The bar 13 is preferably connected to the compacting arm 11 and the pedal 10 with a hinge 14. The compacting arm 11 is then connected on one of its ends to the base 3 with a hinge 15 around which the compacting arm 11 rotates. Again, any hinge or joint may be used for these connections as readily known to those skilled in the art. As seen in FIG. 4, as the pedal 10 is depressed the compacting arm 11 comes down and compresses the shredded material 4.

Although the present invention has been described in detail with respect to certain preferred versions thereof, other versions are possible. Therefore, the scope of the claims should not be limited to the description of the preferred versions contained herein.

The invention claimed is:

1. A shredder with waste leveler comprised of:

a shredder housing;

a shredding mechanism located inside the housing;

a throat through which material to be shredded is fed into the shredding mechanism;

a base for containing shredded material from the shredding mechanism;

a pedal lever connected to the base comprised of a foot pedal and at least one pedal arm; wherein when a user depresses the foot pedal, the pedal arm inside the base is raised moving the shredded material upward and then allowing it to resettle in a level fashion.

* * * * *